US012365060B2

(12) United States Patent
Gurusamy et al.

(10) Patent No.: US 12,365,060 B2
(45) Date of Patent: Jul. 22, 2025

(54) CHEMICAL MECHANICAL POLISHING CORRECTION TOOL

(71) Applicant: Applied Materials, Inc., Santa Clara, CA (US)

(72) Inventors: Jay Gurusamy, Santa Clara, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 508 days.

(21) Appl. No.: 17/634,534

(22) PCT Filed: Aug. 25, 2020

(86) PCT No.: PCT/US2020/047801
§ 371 (c)(1),
(2) Date: Feb. 10, 2022

(87) PCT Pub. No.: WO2021/041413
PCT Pub. Date: Mar. 4, 2021

(65) Prior Publication Data

US 2022/0324081 A1 Oct. 13, 2022

Related U.S. Application Data

(60) Provisional application No. 62/892,334, filed on Aug. 27, 2019.

(51) Int. Cl.
*B24B 37/34* (2012.01)
*B24B 37/32* (2012.01)
*B24B 53/017* (2012.01)

(52) U.S. Cl.
CPC ..... *B24B 37/34* (2013.01); *B24B 37/32* (2013.01); *B24B 53/017* (2013.01)

(58) Field of Classification Search
None
See application file for complete search history.

(56) References Cited

U.S. PATENT DOCUMENTS 4,892,455 A 1/1990 Hine
6,146,256 A * 11/2000 Joo ..... B24B 37/32 451/287

(Continued)

FOREIGN PATENT DOCUMENTS

CN 101342679 1/2009
CN 101934491 1/2011

(Continued)

OTHER PUBLICATIONS

Machine Translation of JP 2002079454 to Takahashi ("Takahashi Translation"). (Year: 2002).*

(Continued)

*Primary Examiner* — Monica S Carter
*Assistant Examiner* — Jonathan R Zaworski
(74) *Attorney, Agent, or Firm* — Fish & Richardson P.C.

(57) ABSTRACT

A chemical mechanical polishing touch-up tool includes a pedestal configured to support a substrate, a plurality of jaws configured to center the substrate on the pedestal, a loading ring to apply pressure to an annular region on a back side of the substrate on the pedestal, a polishing ring to bring a polishing material into contact with an annular region on a front side of the substrate that is aligned with the annular region on the back side of the substrate, and a polishing ring actuator to rotate the polishing ring to cause relative motion between the polishing ring and the substrate.

10 Claims, 10 Drawing Sheets

(56) References Cited

U.S. PATENT DOCUMENTS

| | | | | |
|---|---|---|---|---|
| 9,308,621 | B2 | 4/2016 | Fukushima et al. | |
| 9,662,762 | B2 * | 5/2017 | Gurusamy | B24B 37/042 |
| 10,744,615 | B2 | 8/2020 | Sato et al. | |
| 11,559,869 | B2 | 1/2023 | Ando et al. | |
| 11,772,228 | B2 * | 10/2023 | Chang | B24B 37/015 451/28 |
| 2001/0029150 | A1 | 10/2001 | Kimura et al. | |
| 2002/0006768 | A1 | 1/2002 | Wada et al. | |
| 2005/0260933 | A1 | 11/2005 | Kimura et al. | |
| 2007/0037486 | A1 * | 2/2007 | Kang | B24D 7/14 451/41 |
| 2009/0277583 | A1 | 11/2009 | Ensinger et al. | |
| 2012/0034846 | A1 | 2/2012 | Minamihaba et al. | |
| 2014/0357164 | A1 | 12/2014 | Nabeya et al. | |
| 2015/0111478 | A1 * | 4/2015 | Chen | B24B 37/10 451/72 |
| 2015/0224620 | A1 | 8/2015 | Takahashi et al. | |
| 2016/0005618 | A1 | 1/2016 | Chen et al. | |
| 2016/0016279 | A1 | 1/2016 | Gurusamy et al. | |
| 2021/0237224 | A1 * | 8/2021 | Kobata | B24B 37/005 |

FOREIGN PATENT DOCUMENTS

| | | | | |
|---|---|---|---|---|
| CN | 203305047 | | 11/2013 | |
| CN | 108290269 | | 7/2018 | |
| CN | 109937117 | | 6/2019 | |
| JP | H11-333677 | | 12/1999 | |
| JP | 2000-006002 | | 1/2000 | |
| JP | 2001-287142 | | 10/2001 | |
| JP | 2002079454 | A * | 3/2002 | |
| JP | 2005-038935 | | 2/2005 | |
| JP | 2009-111024 | | 5/2009 | |
| JP | 2012-054529 | | 3/2012 | |
| JP | 2017-525582 | | 9/2017 | |
| KR | 10-2001-0076834 | | 8/2001 | |
| TW | 201438845 | | 10/2014 | |
| WO | WO-9928083 | A1 * | 6/1999 | B24B 37/20 |

OTHER PUBLICATIONS

Office Action in Chinese Appln. No. 202080060233.4, dated Jul. 28, 2023, 15 pages (with English translation).

Office Action in Japanese Appln. No. 2022-511252, dated Jul. 4, 2023, 4 pages (with English translation).

Office Action in Taiwanese Appln. No. 109128864, dated Feb. 27, 2024, 14 pages (with English summary and search report).

International Search Report and Written Opinion in related International Application No. PCT/US2020/047801, dated Nov. 27, 2020, 12 pages.

Office Action in Chinese Appln. No. 202080060233.4, dated Mar. 29, 2024, 11 pages (with English translation).

Notice of Allowance in Chinese Appln. No. 202080060233.4, dated Jun. 5, 2024, 8 pages (with English translation).

* cited by examiner

CHEMICAL MECHANICAL POLISHING CORRECTION TOOL

CROSS REFERENCE TO RELATED APPLICATIONS

This application is a U.S. National Stage Application under 35 U.S.C. § 371 and claims the benefit of International Patent Application No. PCT/US2020/047801, filed on Aug. 25, 2020, which claims the benefit of priority to U.S. Provisional Patent Application No. 62/892,334, filed on Aug. 27, 2019.

TECHNICAL FIELD

This disclosure relates to a polishing tool for use in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a chemical mechanical polishing touch-up tool includes a pedestal configured to support a substrate, a plurality of jaws configured to center the substrate on the pedestal, a loading ring to apply pressure to an annular region on a back side of the substrate on the pedestal, a polishing ring to bring a polishing material into contact with an annular region on a front side of the substrate that is aligned with the annular region on the back side of the substrate, and a polishing ring actuator to rotate the polishing ring to cause relative motion between the polishing ring and the substrate.

In another aspect, a chemical mechanical polishing touch-up tool includes a pedestal configured to support a substrate, an asymmetry-correction ring including a plurality independently vertically movable segments to apply independently controllable pressures to a plurality of angularly disposed zones of an annular region on a back side of the substrate on the pedestal, a polishing ring to bring a polishing material into contact with an annular region on a front side of the substrate that is aligned with the annular region on the back side of the substrate, and a polishing ring actuator to rotate the polishing ring to cause relative motion between the polishing ring and the substrate.

In another aspect, a method for chemical mechanical polishing touch-up includes supporting a substrate on a pedestal, engaging a front side of the substrate with a polishing ring, engaging a back side of the substrate with an asymmetry-correction ring, holding the back side of the substrate to the asymmetry-correction ring, and polishing the front side of the substrate with the polishing ring.

Implementations may include one or more of the following.

The segmented polishing ring may have four to twelve segments. The back side of the substrate may be suctioned to the asymmetry-correction ring. The substrate may be held stationary. Slurry may be dispensed onto the front side of the substrate. The polishing ring may be conditioned using a conditioning pad on a jaw used to center the substrate on the pedestal.

Advantages of the foregoing may include, but are not limited to, one or more of the following. Under-polishing of one or more regions of the substrate following a bulk polishing operation can be corrected. Asymmetrical polishing can also be corrected. Consequently, within-wafer uniformity and wafer-to-wafer uniformity can be improved.

The details of one or more implementations are set forth in the accompanying drawings and the description below. Other aspects, features, and advantages will be apparent from the description and drawings, and from the claims.

DETAILED DESCRIPTION

Figure 1:
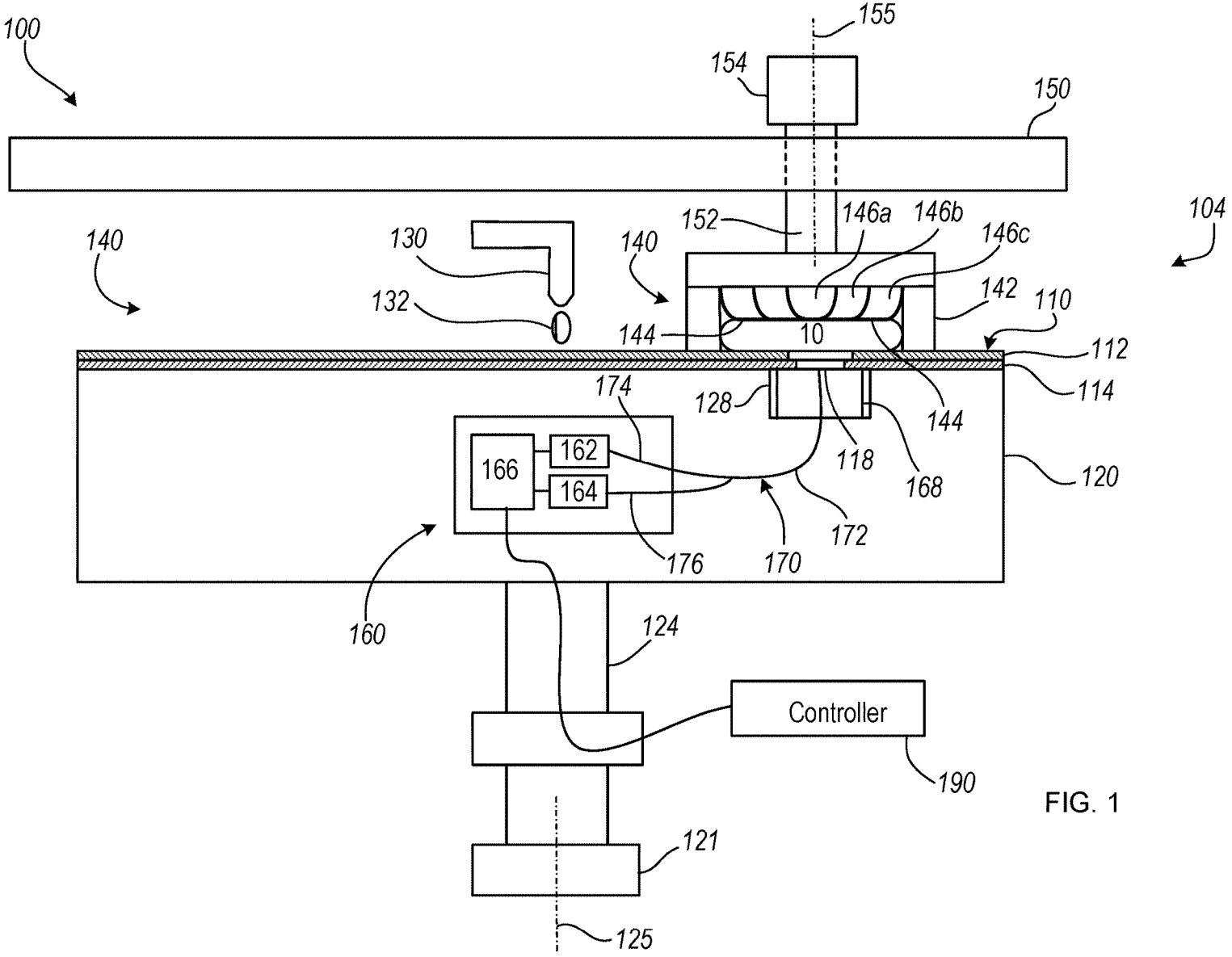
FIG. 1 is a schematic cross-sectional view of a polishing system.

Some polishing processes result in thickness non-uniformity across the surface of the substrate. For example, a bulk polishing process can result in under-polished regions on the substrate. To address this problem, after the bulk polishing it is possible to perform a "touch-up" polishing process that focuses on portions of the substrate that were underpolished.

In a bulk polishing process, polishing occurs over all of the front surface of the substrate, albeit potentially at different rates in different regions of the front surface. Not all of the surface of the substrate might be undergoing polishing at a given instant in a bulk polishing process. For example, due to the presence of grooves in the polishing pad, some portion of the substrate surface might not be in contact with the polishing pad. Nevertheless, over the course of the bulk polishing process, due to the relative motion between the polishing pad and substrate, this portion is not localized, so that all of the front surface of the substrate is subjected to some amount of polishing.

In contrast, in a "touch-up" polishing process, the polishing pad can contact less than all of the front surface of the substrate. In addition, the range of motion of the polishing pad relative to the substrate is configured such that over the course of the touch-up polishing process, the polishing pad contacts only a localized region of the substrate, and a significant portion (e.g., at least 50%, at least 75%, or at least 90%) of the front surface of the substrate never contacts the polishing pad and thus is not subject to polishing at all.

As noted above, some bulk polishing processes result in non-uniform polishing. In particular, some bulk polishing processes result in localized non-concentric and non-uniform spots that are underpolished. Hypothetically, a polishing "touch-up" could be performed using a very small pad that is moved across the under-polished region. However, this may be impractical due to low throughput.

One solution to address local non-uniformity is to use a separate polishing "touch-up" tool that includes a loading ring that can apply pressure to a localized annular region of the substrate. The larger contact area of the loading ring permits more of the under-polished region to be polished simultaneously, resulting in higher throughput. In particular, such a ring is able to address a common issue of an annular underpolished region near the edge of the substrate.

To address local asymmetry, the loading ring can be segmented with different pressures being applied to different segments of the ring. The substrate can be centered on a pedestal, and the segmented asymmetry-correction ring can apply pressure angularly asymmetrically on the back surface of the substrate. In addition, a polishing ring can apply pressure to and rotate against the front surface of the substrate to polish the substrate. Because the polishing rate is proportional to the pressure from the asymmetry-correction ring, non-uniformity can be reduced and asymmetry can be corrected.

FIG. 1 illustrates an example of a polishing system 100 that includes a bulk polishing apparatus 104. A substrate 10 to be polished can be transferred between the bulk polishing apparatus 104 for bulk polishing and a polishing touch-up tool 200 (see FIGS. 2-7) for correction of polishing non-uniformity, e.g., edge modification. For example, the substrate can be transported to the polishing touch-up tool 200 concurrently with or after the bulk polishing of the substrate 10 at the polishing apparatus 104. The transfer of the substrate 10 can be made using a mechanism, e.g., a load/unload assembly or a robotic arm, between the station 102 and the apparatus 104. In some implementations, the modification station 102 is a stand-alone system. In this case, the modification station 102 can be located in the vicinity of the bulk polishing apparatus 104, e.g., in the same processing room.

The polishing apparatus 104 includes one or more carrier heads 140 (only one shown). Each carrier head 140 is operable to hold a substrate 10, such as a wafer, against the polishing pad 110. Each carrier head 140 can have independent control of the polishing parameters, for example pressure, associated with each respective substrate.

Each carrier head 140 includes a retaining ring 142 to hold the substrate 10 in position on the polishing pad 110 and below a flexible membrane 144.

Each carrier head 140 can optionally include a plurality of independently controllable pressurizable chambers defined by the membrane, e.g., three chambers 146*a*-146*c*, which can apply independently controllable pressurizes to associated zones on the flexible membrane 144 and thus on the substrate 10.

Each carrier head 140 is suspended from a support structure 150, e.g., a carousel or a track, and is connected by a drive shaft 152 to a carrier head rotation motor 154 so that the carrier head can rotate about an axis 155. Optionally each carrier head 140 can oscillate laterally, e.g., on sliders on the carousel 150; by rotational oscillation of the carousel itself, or by motion of a carriage that supports the carrier head 140 along the track.

The platen 120 included in the polishing apparatus 104 is a rotatable disk-shaped platen on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 104 can include a port 130 to dispense polishing liquid 132, such as a slurry, onto the polishing pad 110 to the pad. The polishing apparatus can also include a polishing pad conditioner to abrade the polishing pad 110 to maintain the polishing pad 110 in a consistent abrasive state.

In operation, the platen is rotated about its central axis 125, and each carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

In some implementations, the polishing apparatus includes an in-situ monitoring system 160. The in-situ monitoring system can be an optical monitoring system, e.g., a spectrographic monitoring system, which can be used to measure a spectrum of reflected light from a substrate undergoing polishing. An optical access through the polishing pad is provided by including an aperture (i.e., a hole that runs through the pad) or a solid window 118. The in-situ monitoring system can alternatively or in addition include an eddy current monitoring system.

In some implementation, the optical monitoring system 160 is an in-sequence optical monitoring system having a probe (not shown) positioned between two polishing apparatuses or between a polishing apparatus and a transfer station. The monitoring system 160 can continuously or periodically monitor one or more features of the zones of the substrate during polishing. For example, one feature is a thickness of each zone of the substrate.

In either the in-situ or in-sequence embodiments, the optical monitoring system 160 can include a light source 162, a light detector 164, and circuitry 166 for sending and receiving signals between a remote controller 190, e.g., a computer, and the light source 162 and light detector 164. One or more optical fibers 170 can be used to transmit the light from the light source 162 to the optical access in the polishing pad, and to transmit light reflected from the substrate 10 to the detector 164.

Figure 2:
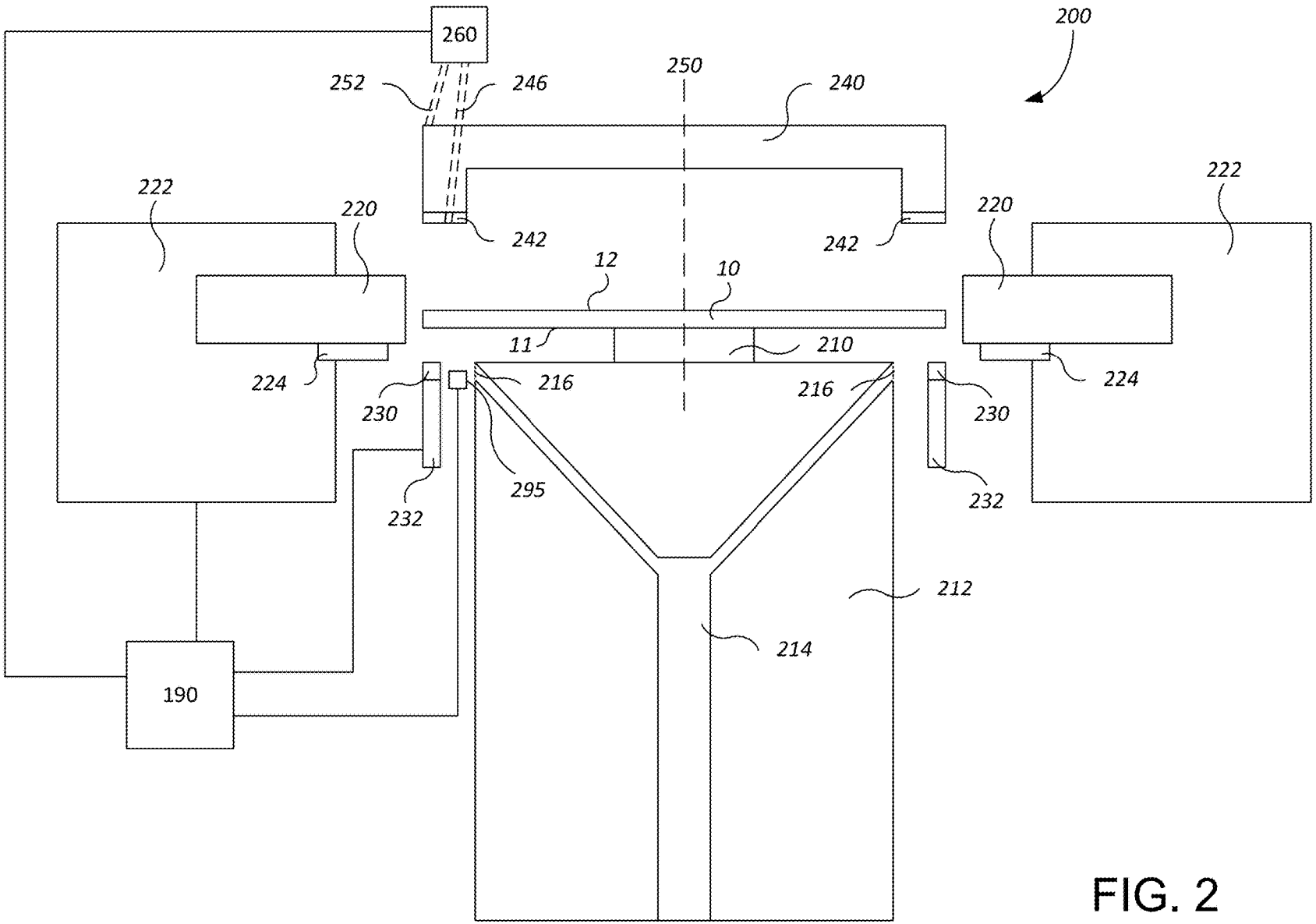
FIGS. 2-7 are schematic cross-sectional views of a polishing touch-up tool.

Referring to FIG. 2, a polishing touch-up tool 200 configured to perform a polishing-touch-up, i.e., polishing correction, operation includes a pedestal 210 situated on a base 212. The pedestal 210 is configured to support a front side 11 of the substrate 10. The substrate 10 can be loaded into the polishing touch-up tool 200 using a carrier head, e.g., the carrier head 140. The base 212 can include one or more slurry channels 214 with one or more slurry dispensers 216.

The polishing touch-up tool 200 also includes a plurality (e.g., three or more) of jaws 220 configured to close radially inward toward the substrate 10. This acts to align the center of the substrate 10 with a standard axis 250. Each jaw 220 can be driven by a separate jaw actuator 222, or a common actuator can drive all of the jaws 222. The jaw actuator 222 can be, for example, a motor, a hydraulic chamber, a pneumatic chamber, a screw thread drive, or other similar actuator. A conditioning pad 224 can be connected to the jaw 220.

The polishing touch-up tool 200 also includes a polishing ring 230 that is coaxial with the axis 250. The polishing ring 230 can be an annular polishing ring with a plurality of arcuate segments. For example, the polishing ring 230 can be composed of four to twelve segments. A polishing ring actuator 232 can be configured to move the polishing ring 230 to engage the front side 11 of the substrate 10.

Figure 8:
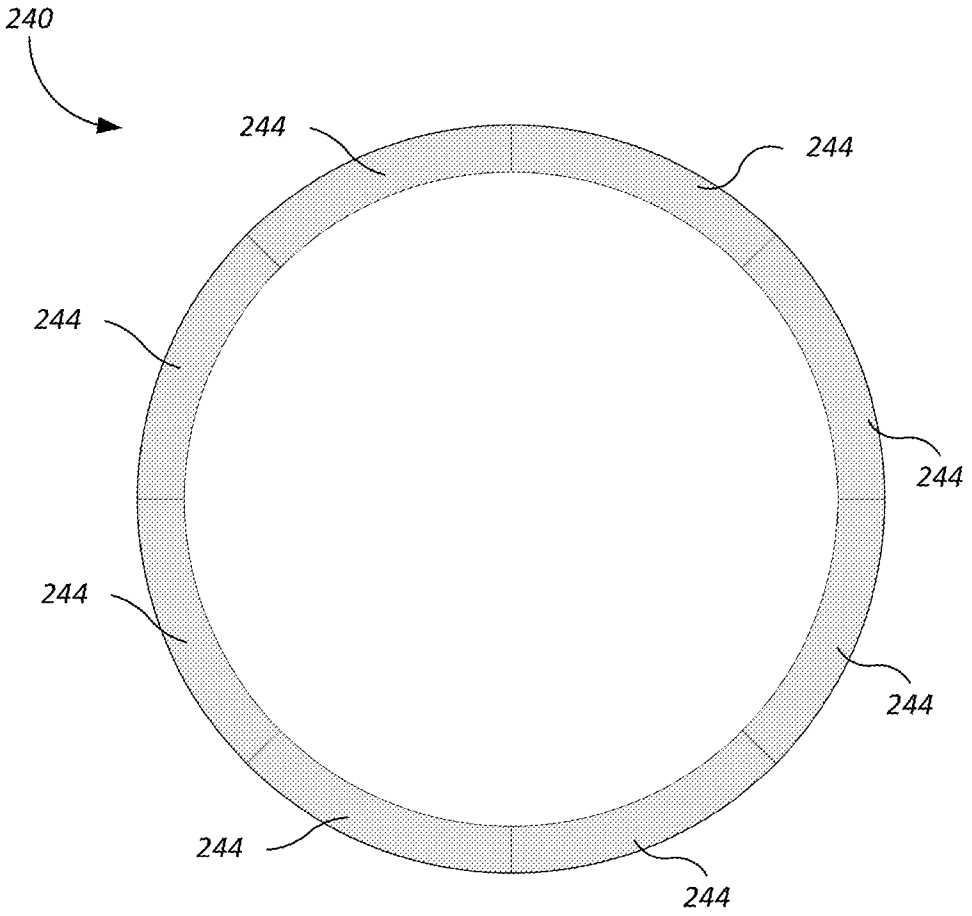
FIG. 8 is a schematic bottom-view of an asymmetry-correction ring.

The polishing touch-up tool 200 also includes a loading ring 240 (see also FIG. 8). The loading ring 240 can be an annular ring configured to contact an annular portion of the back side 12 of the substrate 10 that corresponds to the annular portion of the front side 11 of the substrate 10 that is polished by the polishing ring 230. The width of the loading ring 240 can be wider than the width of the polishing ring 230. The loading ring 230 can also be coaxial with the axis 250.

The loading ring 240 can include a chuck 242 configured to engage and chuck the back side 12 of the substrate 10. For example, a number of vacuum channels 246 can run from a vacuum source 260, e.g., a pump, a facilities vacuum line with a control valve, etc., through the loading ring 240 and to the chuck 242. This permits the chuck 242 to hold (e.g., suction mount) the substrate 10 on the loading ring 240.

Figure 9:
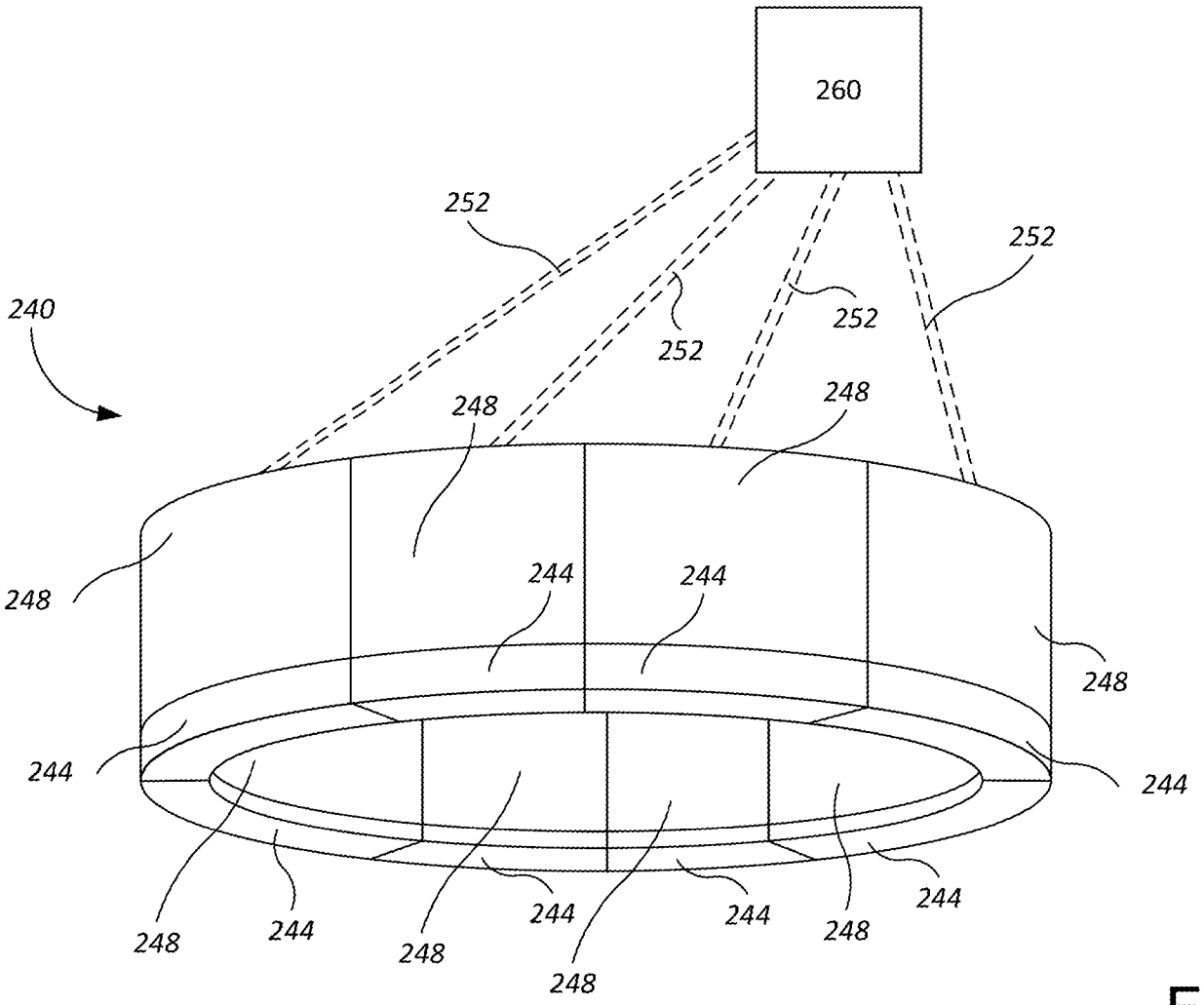
FIG. 9 is a schematic perspective view of an asymmetry-correction ring.
Figure 10:
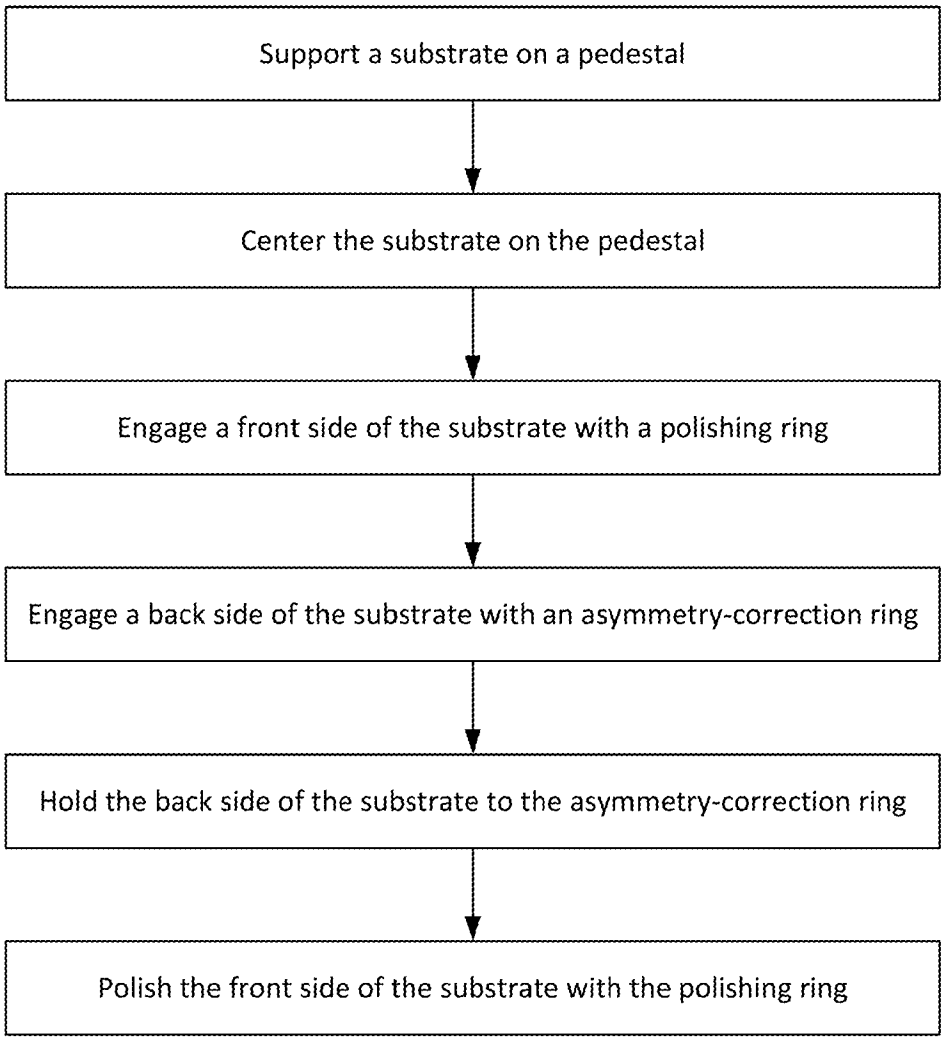
FIG. 10 is a flowchart of a polishing touch-up operation.

In some implementations, the loading ring 240 is an asymmetry-correction ring configured to address asymmetry of the substrate 10. Referring to FIGS. 8-9, the loading ring 240 can be a segmented annular ring having a plurality of arcuate segments 244. The downward pressure on each segment 244 can be controlled to correct asymmetry on the front side 11 of the substrate 10 (e.g., substrate asymmetry resulting from a prior polishing operation). There can be four to twelve segments 244. Each segment 244 in the loading ring 240 can have a corresponding individually pressurizable chamber 248. The independently pressurizable zone chambers 248 can be connected to the pressure source 260 using channels 252 and pressurized using the pressure source 260. This permits the asymmetry-correction ring configured to apply different pressures to a plurality of arcuate zones on the substrate 10.

Figure 3:
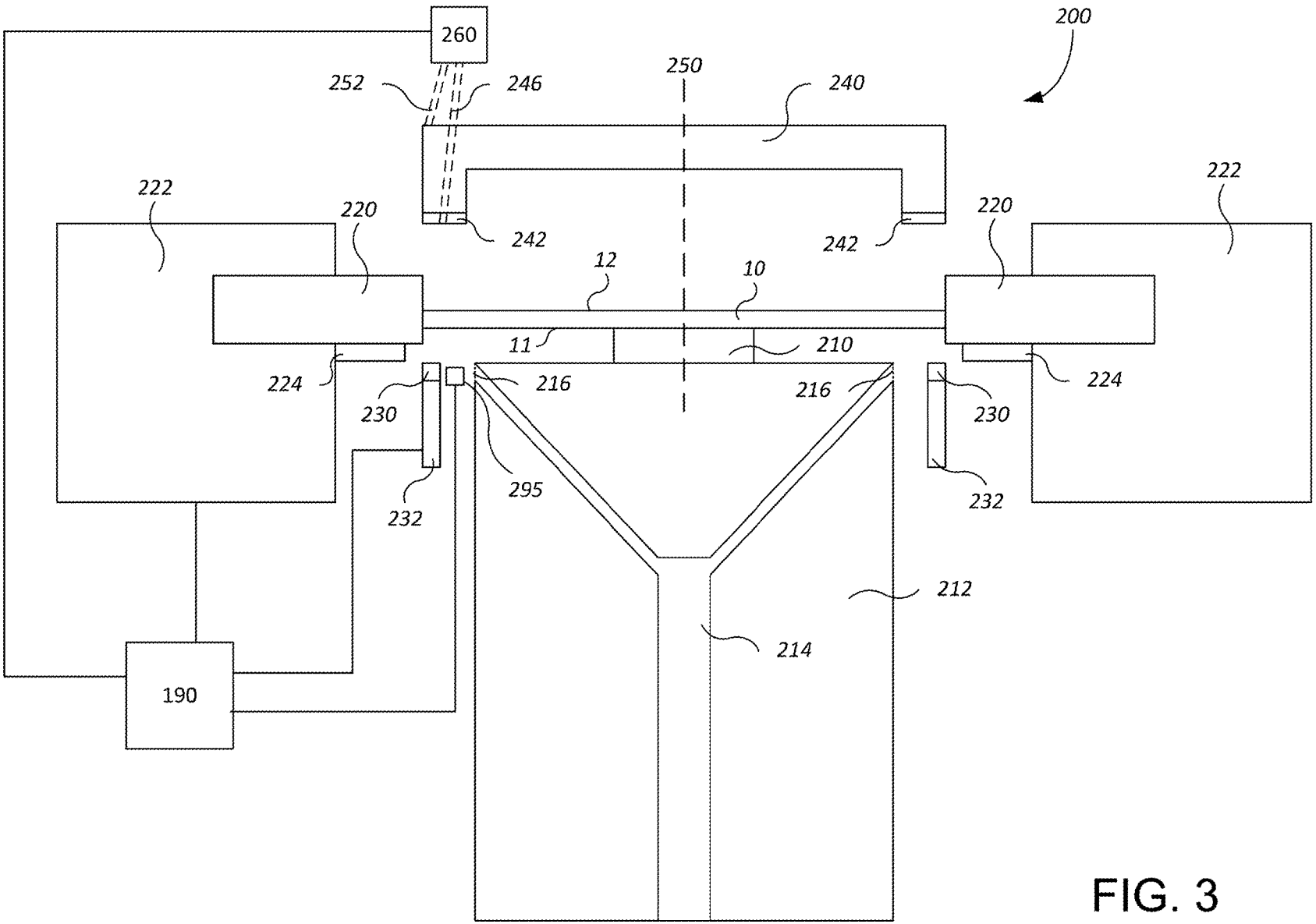

Referring to FIG. 3, after the substrate 10 is loaded onto the pedestal 210, the plurality jaws 220 can engage the edge of the substrate 10. The jaws 220 can be used to center the substrate 10 on the pedestal 210. In particular, the jaws 220 can close radially inward to urge the substrate 10 to a position in which the substrate 10 is coaxial with the axis 250.

The jaw actuator(s) 222 can cause the jaw 220 to close inwardly on the substrate 10 until the jaws 220 encounter some resistance from engaging the substrate 10. The jaw actuator(s) 222 can then cause the jaws 220 disengage, e.g., open, from the substrate 10 to allow for some clearance between the jaws 220 and the substrate 10. For example, the jaw actuators 222 can cause the jaws 220 to leave a small clearance, e.g., 0.1 to 3 mm, between the jaw 220 and the substrate 10.

Figure 4:
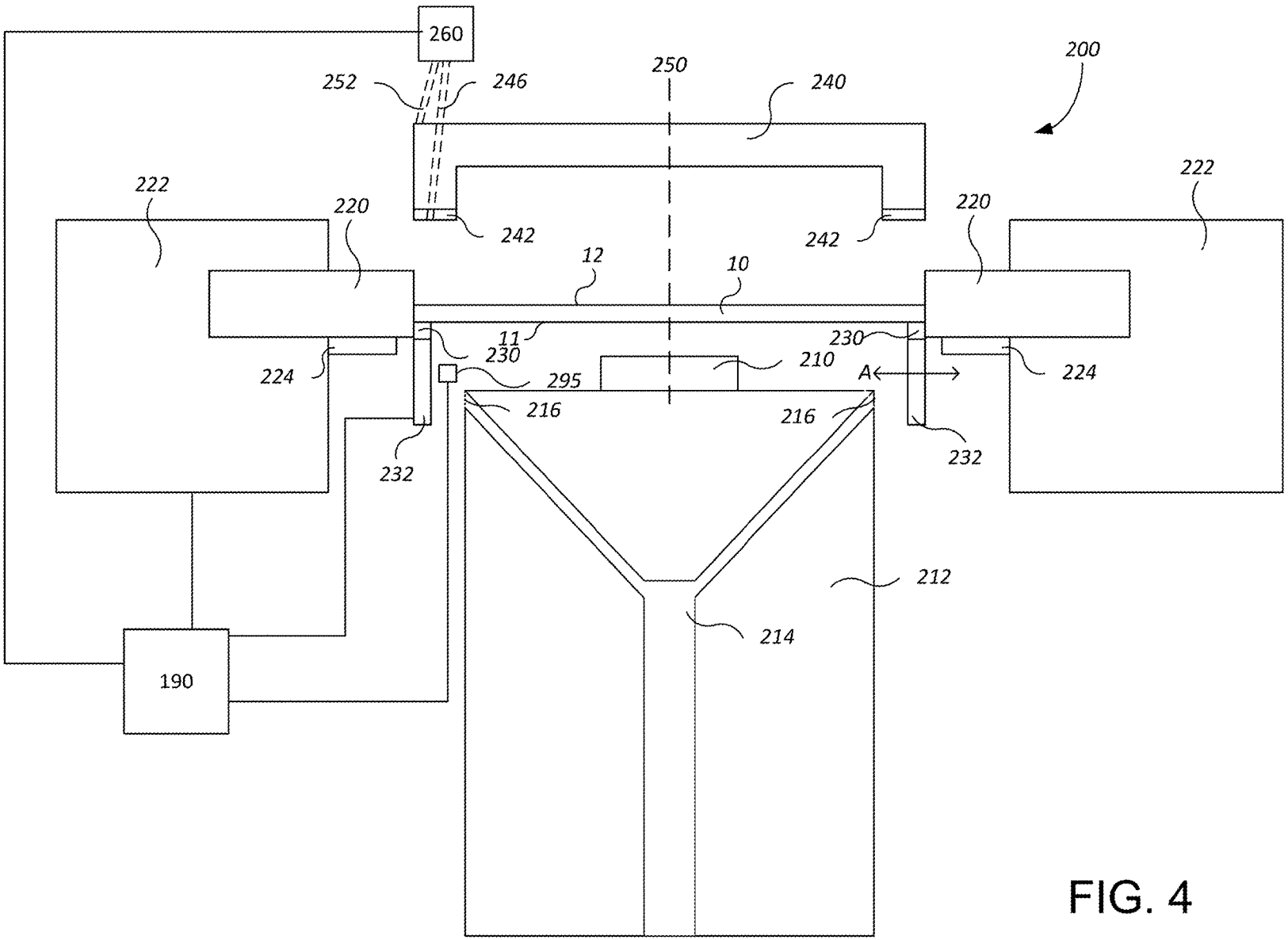

Referring to FIG. 4, once the substrate 10 is centered on the pedestal, the polishing ring 230 is moved to engage an annular region of the front side 11 of the substrate 10. The polishing ring actuator 232 can cause the plurality of arcuate segments 244 of the polishing ring 230 to radially move, and cause the polishing ring 230 to polish different portions of the front side 11 of the substrate 10 (arrow A). Thus, the polishing ring 230 can polish different portions of the front side 11 of the substrate 10, e.g., an annular zone between the edge and 5 mm from the edge, or an annular zone between 20 and 50 mm from edge of the substrate.

The polishing ring actuator 232 can move the polishing ring 230 vertically toward or away from the substrate 10, and to lift or lower the substrate 10. Optionally, the polishing ring actuator 232 can cause the segments of the polishing ring 230 to move inward and outward, e.g., to polish different radii of the substrate 10. The polishing ring 230 can engage the substrate 10 and then lift the substrate 10 off of the pedestal 210.

Figure 5:
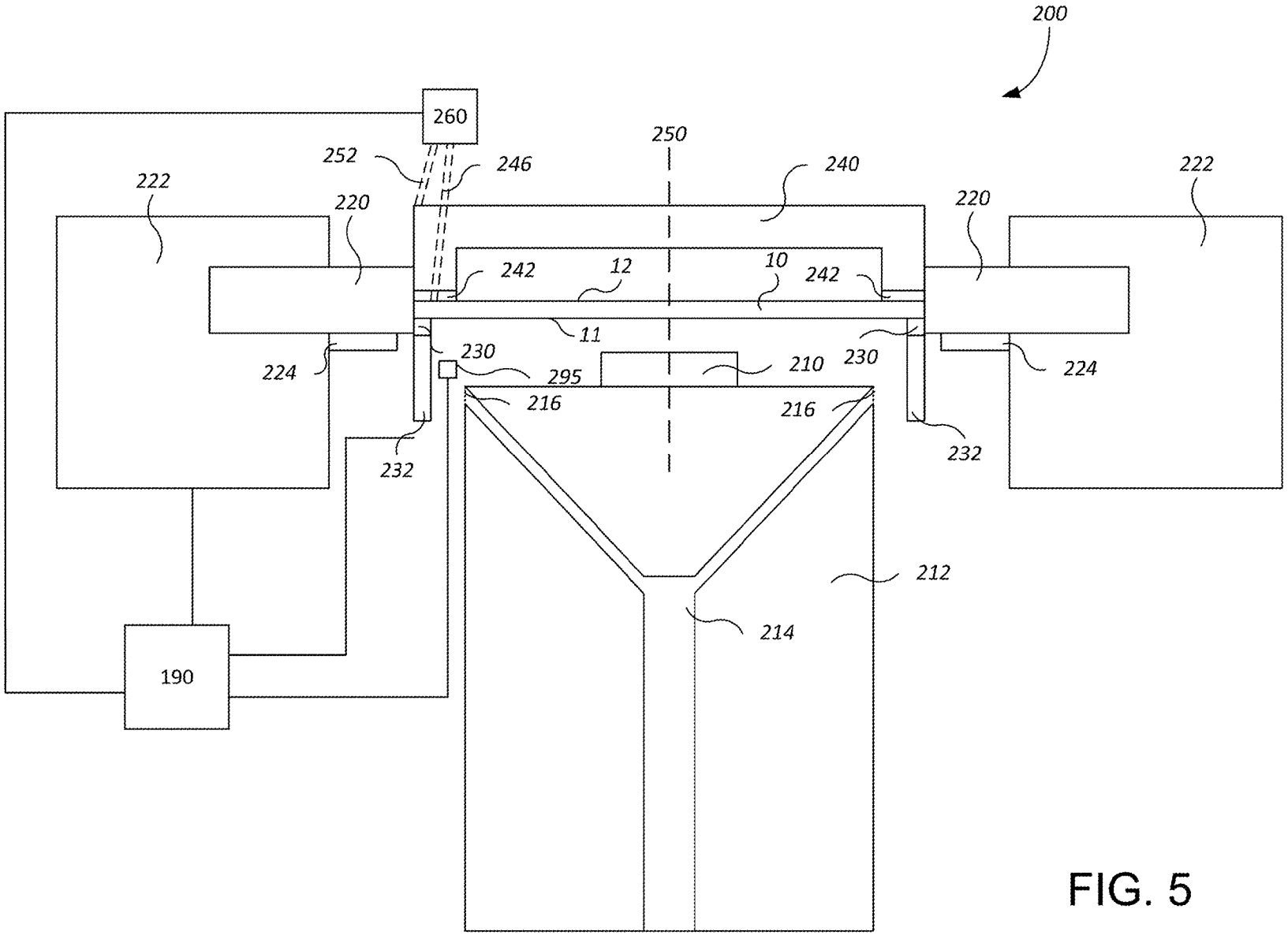

Referring to FIG. 5, the loading ring 240 can engage an annular region of the back side 12 of the substrate 10. In some implementations, the substrate 10 can sit on the pedestal 210 as it is engaged by the loading ring 240. In some implementations, the substrate 10 could be chucked to the loading ring 240, and lifted off of the pedestal 210 by vertical motion of the loading ring 210. In some implementations, the substrate 10 could be lifted off of the pedestal 210 by vertical motion of the polishing ring 230, and then engaged (e.g., chucked) to the loading ring 240.

After the loading ring engages the substrate 10 (e.g., after the chuck 242 chucks the substrate 10 to the loading ring 240), the polishing ring actuator 232 can cause the polishing ring 230 to rotate and polish a portion of, e.g., the edge of, the front side 11 of the substrate 10. While the polishing ring 230 rotates, the loading ring 240 can be stationary, causing the substrate 10 to be stationary. The slurry channel 214 (discussed above) can deliver slurry to the front side 11 of the substrate 10 during this edge control operation using the slurry dispensers 216.

Assuming the loading ring 240 is an asymmetry-correction ring, the chambers 248 can be independently pressurized to different pressures so that the different segments 244 of the loading ring 240 apply pressure different pressures to a plurality of angularly disposed zones in an annular region of the back side 12 of the substrate 10. The pressure applied by the loading ring 240 on the substrate 10 can cause the different zones on the front side 11 of the substrate 10 to be polished at different rates, which permits the polishing touch-up tool 200 to correct the substrate asymmetry.

Figure 6:
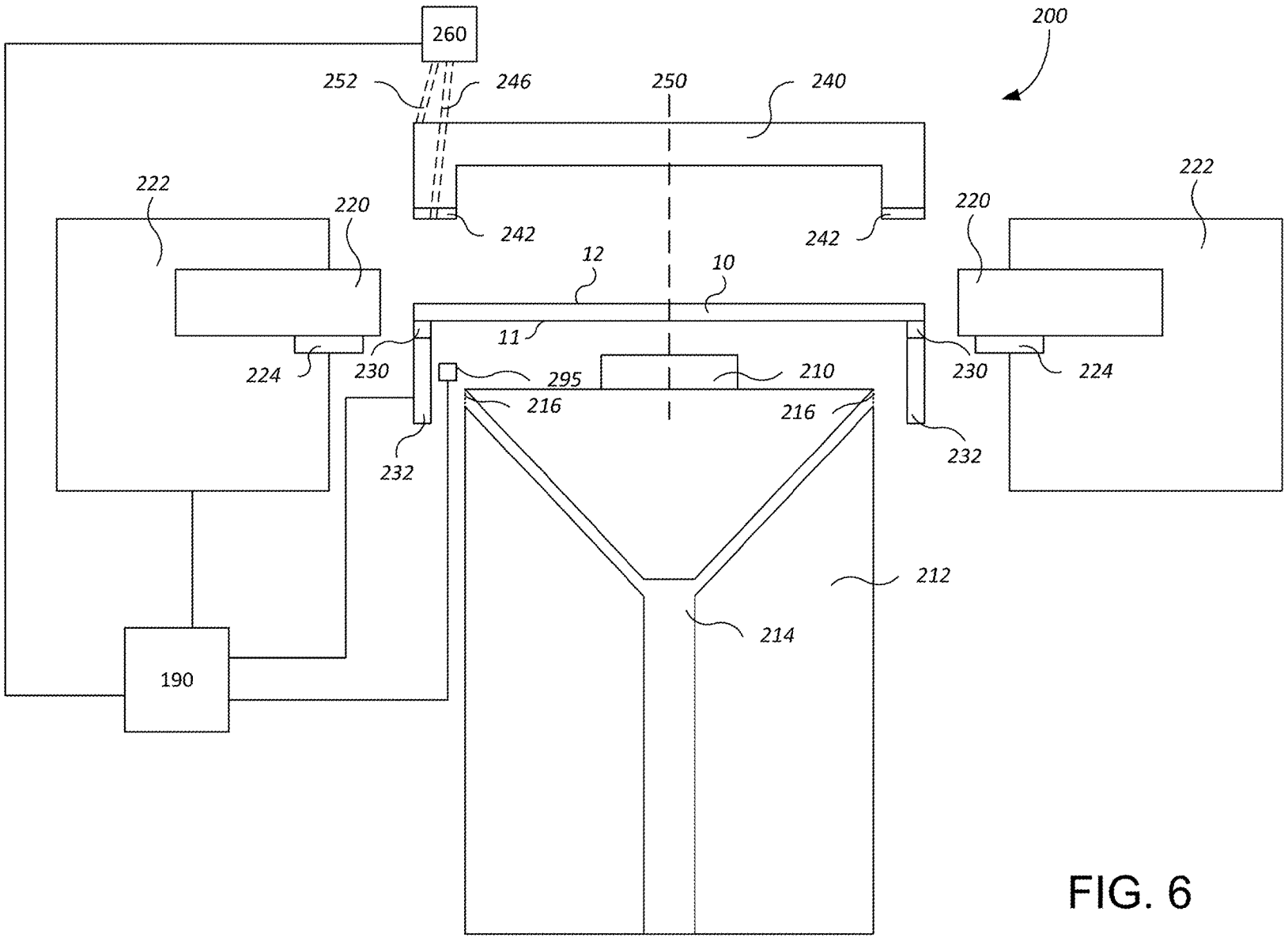

Referring to FIG. 6, after the touch-up operation (e.g., correction or edge control operation) is performed, the loading ring 240 disengages from the substrate 10 (e.g., stops suction-chucking the substrate 10) so that the substrate 10 rests on the polishing ring 230.

The jaws 220 can also move away from the substrate 10. The substrate 10 resting on the polishing ring 230 can then be lifted out of the polishing touch-up tool 200, for example, using the carrier head 140.

Figure 7:
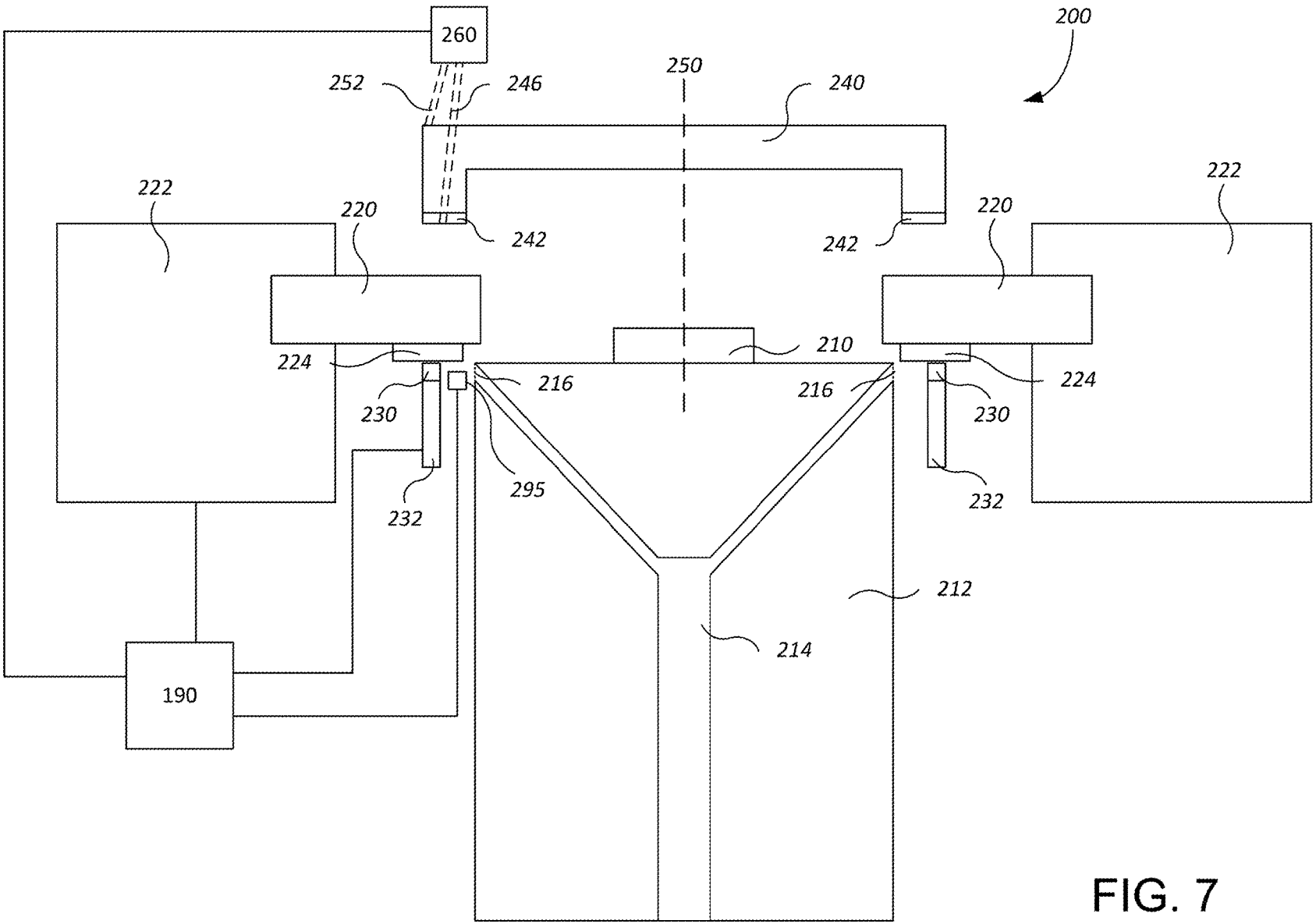

Referring to FIG. 7, once the substrate 10 is removed from the polishing touch-up tool 200, the jaw actuator 222 can cause the jaw 220 to be positioned above the polishing ring 230. Specifically, the conditioning pads 224 located on the jaws 220 can be positioned over the polishing ring 230. The polishing ring actuators 232 can cause the polishing ring 230 to contact the conditioning pads 224, where the conditioning pads 224 can abrade the polishing ring 230 to maintain the polishing ring 230 in a consistent abrasive state. The polishing ring 230 can rotate about a central axis 250 to cause the conditioning pads 224 to abrade the polishing ring 230.

Referring to FIGS. 2-7, the polishing touch-up tool 200 includes a controller 190 coupled to various components of the apparatus, e.g., the pressure source 260, the jaw actuators 222, the polishing ring actuators 232, and the independently pressurizable zone chambers of the loading ring 240. A sensor 295 can be used to detect asymmetry on the front side 11 of the substrate 10. For example, the sensor 295 can be an optical sensor that measures different portions of the front side 11. The sensor 295 can send the measurements to the controller 190, which can then pressurize the independently pressurizable zone chambers of the loading ring 240 to adjust the pressure each zone 244 applies to the back side 12 of the substrate 10 during the edge control operation.

What is claimed is:

1. A chemical mechanical polishing touch-up tool, comprising:

a support to hold a substrate having a planar front surface and a planar back surface;

an asymmetry-correction ring including a plurality of independently vertically movable segments to apply independently controllable pressures to a plurality of angularly disposed zones of an annular region on the planar back surface of the substrate on a pedestal;

a polishing ring to bring an annular piece of polishing material into contact with an annular region on the planar front surface of the substrate that is aligned with the annular region on the planar back surface of the substrate to which pressures are applied by the asymmetry-correction ring, wherein the polishing ring comprises a plurality of radially-movable arcuate segments; and a polishing ring actuator configured to rotate, around a rotation axis, the polishing ring to cause relative motion between the polishing ring and the substrate and to cause the plurality of arcuate segments to move radially inward or outward, wherein the rotation axis of the polishing ring does not intersect the polishing ring actuator, and wherein radial movement of the arcuate segments is decoupled from vertical movement of the arcuate segments.

2. The tool of claim 1, wherein the asymmetry-correction ring includes four to twelve independently vertically movable segments.

3. The tool of claim 1, wherein the asymmetry-correction ring includes a plurality of independently pressurizable zone chambers corresponding to the plurality of independently vertically movable segments.

4. The tool of claim 1, wherein the rotation axis of the polishing ring is coaxial with the asymmetry-correction ring.

5. The tool of claim 1, wherein the asymmetry-correction ring provides a chuck to hold the substrate.

6. The tool of claim 1, wherein a width of the asymmetry-correction ring is greater than a width of the polishing ring.

7. The tool of claim 1, wherein the asymmetry-correction ring includes a channel to vacuum chuck the substrate.

8. The tool of claim 1, wherein the support comprises a pedestal positioned to contact the planar front surface of the substrate.

9. The tool of claim 1, comprising a conditioning pad positioned radially outward of the asymmetry-correction ring, and wherein the plurality of radially-movable arcuate segments are movable, by the polishing ring actuator, below the conditioning pad.

10. The tool of claim 1, further comprising a slurry dispenser having a port located radially inwardly of the polishing ring.

* * * * *